US008201618B2

(12) United States Patent
Yu et al.

(10) Patent No.: US 8,201,618 B2
(45) Date of Patent: Jun. 19, 2012

(54) HEAT DISSIPATION MODULE AND HEAT COLUMN THEREOF

(75) Inventors: Min-Hui Yu, Taoyuan Hsien (TW); Chi-Feng Lin, Taoyuan Hsien (TW); Chin-Ming Chen, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 347 days.

(21) Appl. No.: 11/730,857

(22) Filed: Apr. 4, 2007

(65) Prior Publication Data

US 2007/0277961 A1 Dec. 6, 2007

(30) Foreign Application Priority Data

Jun. 2, 2006 (TW) ..... 95119614 A

(51) Int. Cl.
*B23P 15/26* (2006.01)
*F28D 15/02* (2006.01)

(52) U.S. Cl. ..... 165/104.26; 29/890.032

(58) Field of Classification Search ..... 165/104.19, 165/104.21, 104.26, 177
See application file for complete search history.

(56) References Cited

U.S. PATENT DOCUMENTS

| | | | | |
|---|---|---|---|---|
| 3,448,011 | A * | 6/1969 | Russomanno | 435/297.5 |
| 3,614,959 | A * | 10/1971 | Schollmaier et al. | 134/117 |
| 5,412,535 | A * | 5/1995 | Chao et al. | 361/700 |
| 7,040,382 | B2 * | 5/2006 | Hsu | 165/104.26 |
| 7,324,341 | B2 * | 1/2008 | Oman | 361/700 |
| 2005/0011633 | A1 * | 1/2005 | Garner et al. | 165/104.26 |
| 2005/0199375 | A1 * | 9/2005 | Hsu | 165/104.26 |
| 2006/0283574 | A1 * | 12/2006 | Huang | 165/104.26 |

* cited by examiner

*Primary Examiner* — Teresa Walberg
(74) *Attorney, Agent, or Firm* — Birch, Stewart, Kolasch & Birch, LLP

(57) ABSTRACT

A heat dissipation module includes a heat column and a plurality of heat dissipation fins disposed outside of the heat column and connected with the heat column. The heat column has a column body and a base, and the column body has a top portion and a sidewall ringed with the top portion. The sidewall and the top portion are integrally formed. The base is disposed opposite to the top portion, and the base has an indentation for allowing an end of the sidewall of the column body to insert so as to form a closed space between the base and the column body. The base further has an annular protrusion close to the indentation, and after the end of the sidewall of the column body is inserted into the indentation of the base, the annular protrusion is processed to be filled between the indentation and the sidewall so as to tightly assemble the base and the column body.

12 Claims, 6 Drawing Sheets

60A

60B

HEAT DISSIPATION MODULE AND HEAT COLUMN THEREOF

This Non-provisional application claims priority under U.S.C. §119(a) on Patent Application No(s). 095119614, filed in Taiwan, Republic of China on Jun. 2, 2006, the entire contents of which are hereby incorporated by reference.

BACKGROUND OF THE INVENTION

1. Field of the Invention

The invention relates to a heat dissipation module and heat column thereof, and in particular to an easily manufactured and cost-saving heat dissipation module and heat column thereof.

2. Description of the Related Art

As the number of transistors per unit area of an electronic device increases, the amount of heat generated thereby during operation increases commensurately. Additionally, high operating frequencies and switch loss resulting from switch shifting of transistors contribute to heat production. If the heat is not properly dispersed, operating speed of the electronic device, such as a chip, will decrease and the lifespan of the chip may be shortened. Typically, a heat sink transfers heat generated by the electronic device and then the heat is dissipated to the exterior via fins thereon by natural or forced convection.

A heat pipe can transfer heat over a long distance with a small cross section and under minor temperature differences. The heat pipe can be operated in the absence of power and is thus widely used to remove heat generated by an electronic device. To save power and space, various heat pipes are used to transfer heat in electronic products. FIG. 1 is a sectional view of a conventional heat column. The conventional heat column 10 is constituted of a top cover 14 and a column body 12 with an open end and a closed end. When the top-cover 14 and the column body 12 are assembled, the top cover 14 seals the open end of the column body 12.

The column body 12 is hollow, made by forging, and includes a sidewall 122 and a bottom 124. Wick structures 16*a* and 16*b* are disposed on the inner wall of the column body 12 (i.e. the inner walls of the sidewall 122 and the bottom 124). Further, a filling tube 18 is connected to the center of the top cover 14 for allowing injecting a working fluid W into the interior of the column body 12. After sealing the filling tube 18 and evacuating air within the column body 12 to form vacuum, the heat column 10 is accomplished.

However, conventional manufacture of column body 12 by forging entails high manufacturing costs and the rate of generation of waste materials is high (generally exceeding 50%). Additionally, solder filler used in combining the column body 12 and the top cover 14, the top cover 14 and the filling tube 18 further increases manufacturing costs and complicates manufacturing processes.

Additionally, the wick structure 16*a* and 16*b* in heat column 10 is made by powder sintering. Limited by the sintering mold and manufacturing process, the wick structure 16*b* of the base 124 and the wick structure 16*a* of the sidewall 122 are manufactured together by powder sintering. However, no wick structure is disposed on the internal surface of the top cover 14, providing ineffective condensation, affecting variations in the quantity of the working fluid, degrading the efficiency of heat transfer and overall thermal resistance.

Thus, to solve the problems described above and enhance heat exchange area to improve overall heat dissipation efficiency, a heat column with low cost and simplified process is required.

BRIEF SUMMARY OF THE INVENTION

The invention provides a heat dissipation module with heat column. The number of soldering procedures is decreased so as to simplify assembly processes. Also, heat exchange area is increased to improve overall heat dissipation efficiency.

Accordingly, a heat column is provided. The heat column includes a column body and a base. The heat column has a column body and a base, and the column body has a top portion and a sidewall ringed with the top portion. The sidewall and the top portion are integrally formed. The base is disposed opposite to the top portion, and the base has an indentation for allowing an end of the sidewall of the column body to insert so as to form a closed space between the base and the column body. The base further has an annular protrusion close to the indentation, and after the end of the sidewall of the column body is inserted into the indentation of the base, the annular protrusion is processed to be filled between the indentation and the sidewall so as to tightly assemble the base and the column body. Further, a soldering paste or other solder is applied between the indentation and the sidewall of the column body, and the column body and the base are welded or soldered to form an enclosed chamber.

The base includes a non-flat internal surface. The internal surface is disposed toward the top portion of the column body. The heat column further includes a first wick structure disposed on an inner surface of the sidewall of the column body, a second wick structure disposed on the internal surface of the base and connected with the first wick structure, and a working fluid. The working fluid is filled within the heat column.

Furthermore, the base includes at least one protrusion on the internal surface of the base, and each protrusion is semicircular, curved, triangular, rectangular, square, or trapezoid in cross-section. Or, the base has a plurality of protrusions on the internal surface of the base, and the protrusions form a checker pattern, a determinant pattern, a symmetrical pattern, or a non-symmetrical pattern.

The second wick structure is disposed on the internal surface of the base so that the second wick structure forms a flat plane or a rough plane facing the top portion. The second wick structure on the base includes a first depth and a second depth, and the first depth exceeds the second depth. Alternatively, the second wick structure is disposed along an outline of the internal surface of the base, and the second wick structure has uniform or non-uniform thickness. The sidewall and the top portion of the column body form a hollow column shape. The material of the column body and the base is a high thermal conductive material, such as copper, silver, aluminum, or alloy thereof. The first wick structure and the second wick structure include plastic, metal, alloy, or porous non-metal material. The first structure and the second wick structure are disposed by sintering, gluing, stuffing, or depositing. The working fluid is inorganic compounds, water, alcohol, liquid metal, ketone, CFCs, or organic compounds Additionally, a heat dissipation module is provided. The heat dissipation module includes the above-mentioned heat column and a plurality of heat dissipation fins disposed outside of the heat column and connected with the heat column. The heat column further includes a filling tube integrally formed with the top portion of the column body. The heat dissipation fins, formed by aluminum extrusion or pressing, are spaced and oriented horizontally, vertically, obliquely, or radially and disposed outside of the heat column. Further, the heat dissipation fins are connected to the heat column by soldering, engaging, wedging, or gluing. For example, the heat dissipation fins can be engaged with the heat column by thermal shrink. Additionally, a soldering paste or grease may be disposed between the heat dissipation fins and the heat column.

The heat column directly contacts a heat source or the heat column contacts the heat source through a base or a solid metal block for transmitting heat from the heat source to the heat dissipation fins. The heat source is a heat-generating electronic component, such as a central processing unit (CPU), transistor, server, high-level drawing card, hard disc, power supply, driving controller, multimedia electronic device, wireless base transceiver station or high-level video game station. Furthermore, a fan can be additionally applied to the heat dissipation module for improving heat to dissipate.

A detailed description is given in the following embodiments with reference to the accompanying drawings:

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
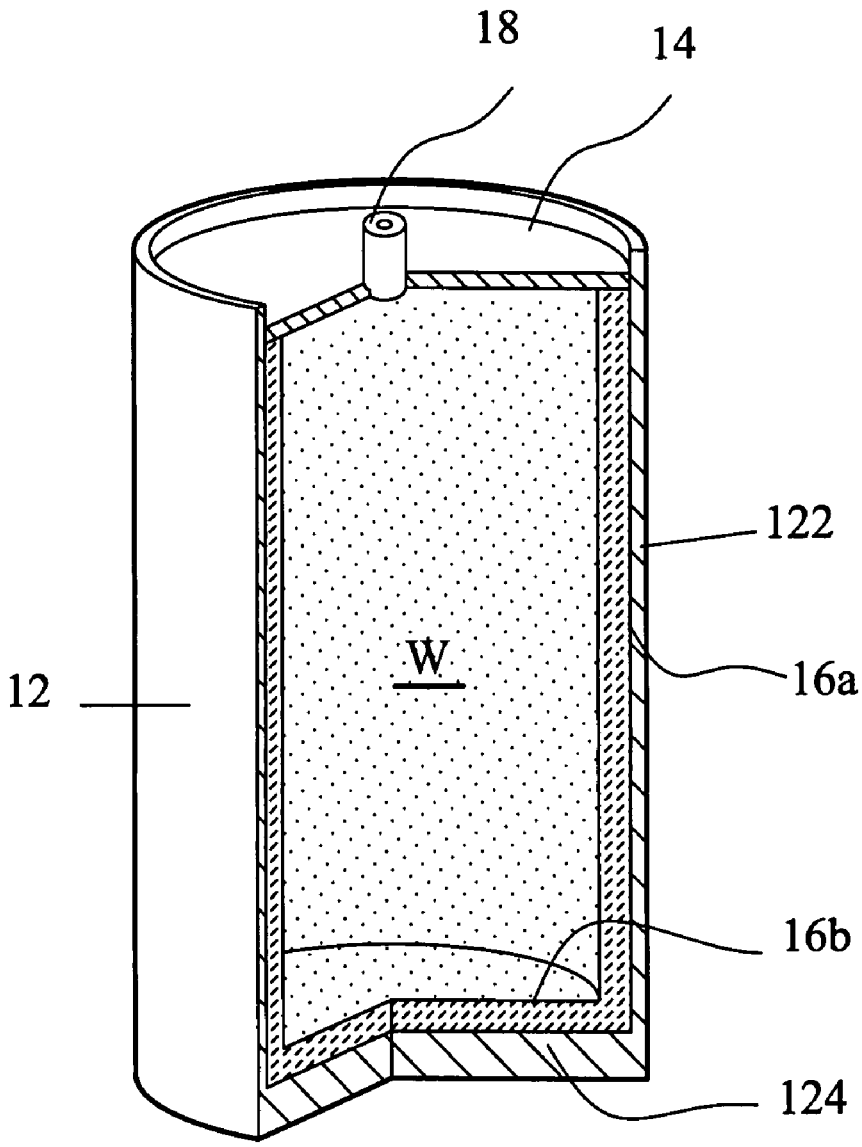
FIG. 1 ( RELATED ART )
FIG. 1 is a sectional view of a conventional heat column.
Figure 2:
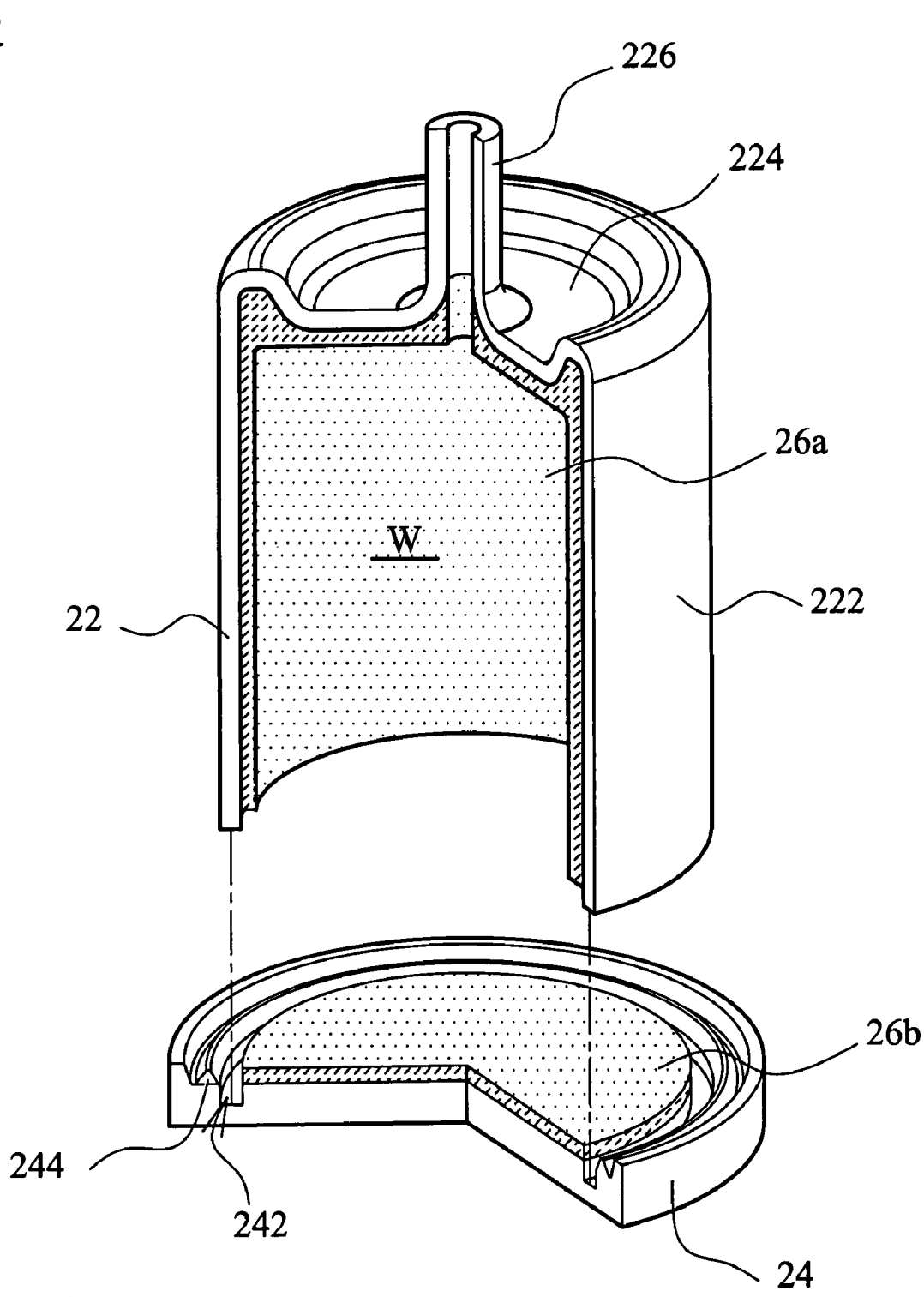
FIG. 2 is a schematic view of an embodiment of a heat column.

FIG. 2 is a schematic view of an embodiment of a heat column 20 including a column body 22 and a base 24. The column body 22 includes a top portion 224 and a sidewall 222 ringed with the top portion 224. The sidewall 222 and the top portion 224 are integrally formed. The column body 22 further includes a filling tube 226 integrally formed with the top portion 224 of the column body 22. The base 24 is disposed opposite to the top portion 224.

Figure 3:
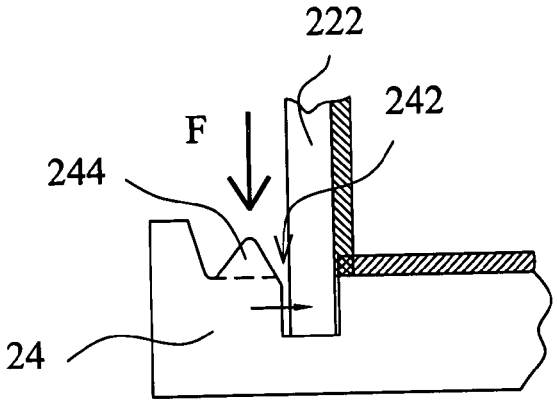
FIG. 3 and FIG. 4 are schematic views of the column body 22 and the base 24 in FIG. 2 during assembling.
Figure 4:
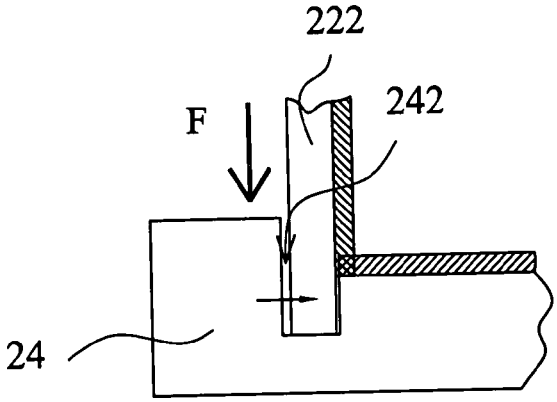

FIG. 3 and FIG. 4 are schematic views of the column body 22 and the base 24 of FIG. 2 during assembling. In FIG. 2, the base 24 can be circular, rectangular, or other shape. The base 24 includes an indentation 242, for example, an annular groove 242, for allowing an end of the sidewall 222 of the column body 22 to insert so as to form a closed space between the base 24 and the column body 22.

As shown in FIG. 2 and FIG. 3, the base 24 further has an annular protrusion 244 close to the annular groove 242. It is noted that FIG. 3 shows that the annular protrusion 244 is not yet pressed, and FIG. 4 shows that the annular protrusion 244 has been pressed to compress the sidewall 222 of the column body 22. After the end of the sidewall 222 of the column body 22 is inserted into the annular groove 242 of the base 24, the annular protrusion 244 is processed to be filled between the annular groove 242 and the sidewall 222 by means of pressing or squeezing, so that the base 24 is tightly engaged with the column body 22, as shown in FIG. 4.

Further, a soldering paste or other solder is applied between the annular groove 242 and the sidewall 222 of the column body 22, and the column body 22 and the base 24 are welded or soldered to form a closed space between the base 24 and the column body 22.

Figure 5:
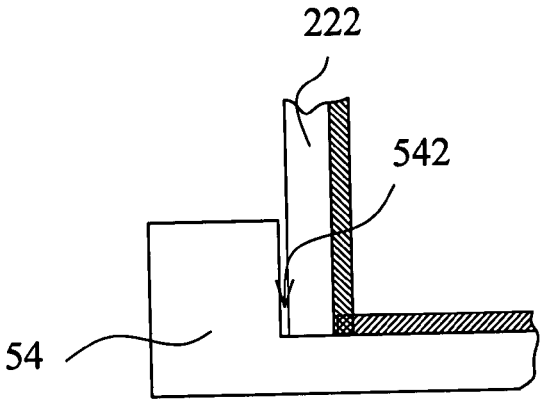
FIG. 5 is a schematic view of another embodiment of the base in FIG. 2.

Alternatively, except of the annular groove, the indentation on the base 24 in FIG. 2 can be a concave platform. As shown in FIG. 5, another embodiment of the base in FIG. 2 has the indentation formed on the base 54 as a concave platform 542. The end of the sidewall 222 of the column body 22 is inserted into the periphery of the concave platform 542. Also, a soldering paste or other solder is applied between the concave platform 542 and the sidewall 222 of the column body 22, and the column body 22 and the base 54 are welded or soldered to form a closed space between the column body 22 and the base 54. Accordingly, waste materials and the number of soldering procedures are decreased, and assembly processes is simplified as are costs.

Figure 6A:
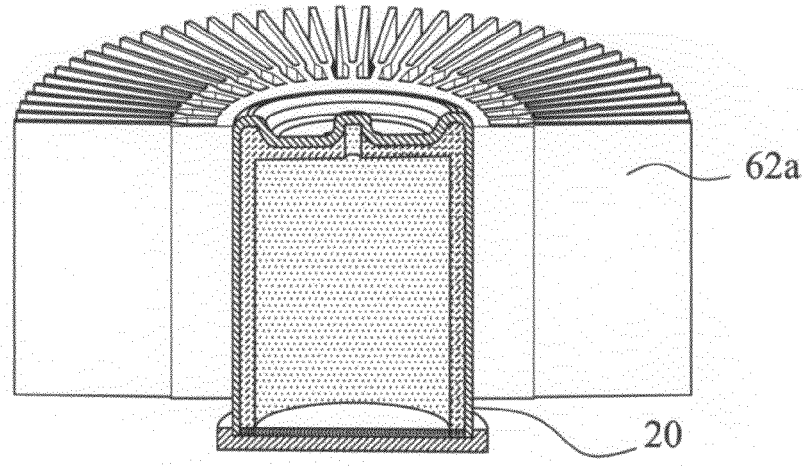
FIG. 6A and FIG. 6B are schematic views of embodiments of heat columns applied to a heat dissipation module.
Figure 6B:
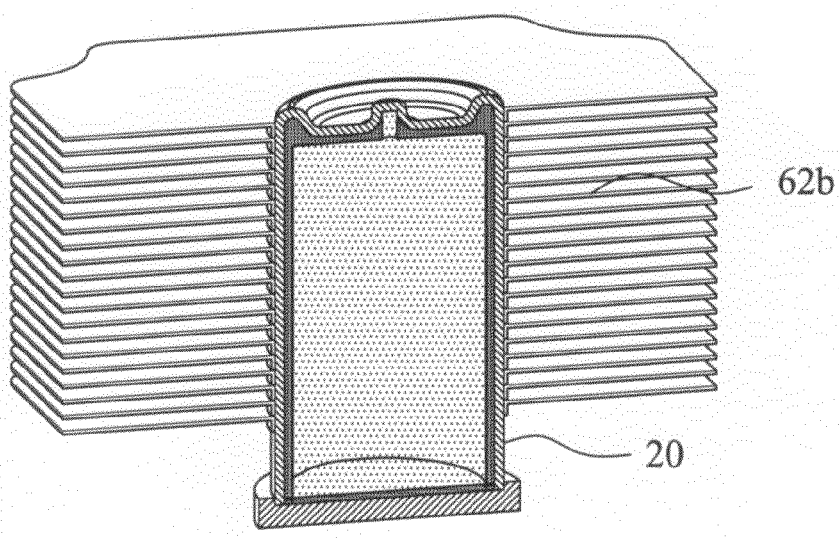

FIG. 6A and FIG. 6B are schematic views of two heat column applied to the heat dissipation module. The heat dissipation module 60A, 60B is applied to a heat source (not shown). The heat column 20 can directly contact a heat source, or the heat column 20 contacts the heat source through an external base (not shown), such as a solid metal block, for transmitting heat from the heat source to the heat dissipation fins 62*a*, 62*b*. The heat source is a heat-generating element, such as a central processing unit (CPU), transistor, server, high-level drawing card, hard disc, power supply, driving controller, multimedia electronic device, wireless base transceiver station or high-level video game station. Additionally, a fan can be additionally applied to the heat dissipation module 60A or 60B for improving heat to dissipate In FIG. 6A, the heat dissipation module 60A includes a heat column 20 and a plurality of heat dissipation fins 62*a*. The heat column 20 is the same as that in FIG. 2, so description thereof is omitted. The heat dissipation fins 62*a*, formed by aluminum extrusion, stamping, pressing, or other process, are disposed outside of the heat column 20. Further, the heat dissipation fins 62*a* are connected with heat column 20 by soldering, locking, engaging, wedging, or gluing. For example, the heat dissipation fins 62*a* can be engaged with the heat column 20 by thermal shrink. Furthermore, a soldering paste or grease is disposed between the heat dissipation fins 62s and the heat column 20.

The heat dissipation fins 62*a* are radially disposed outside of the heat column 20 and are connected with the heat column 20. Alternatively, as shown in FIG. 6B, the heat dissipation fins 62*b* are disposed around the heat column 20, wherein the heat dissipation fins 62*b* are spaced apart and oriented horizontally, and the heat dissipation fins 62*b* are horizontally disposed with each other. Note that arrangement of the heat dissipation fins is not limited to that described, and can include spacing and orientation vertically, obliquely, or in other manners.

Figure 7A:
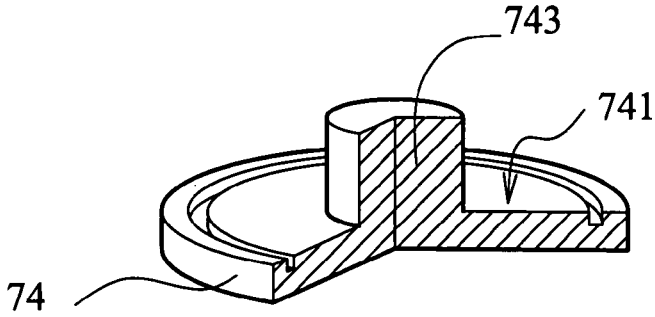
FIGS. 7A-7C are schematic views of different kinds of base.
Figure 7B:
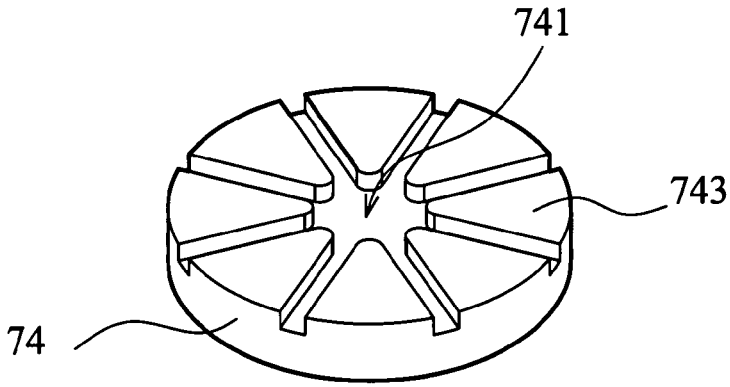
Figure 7C:
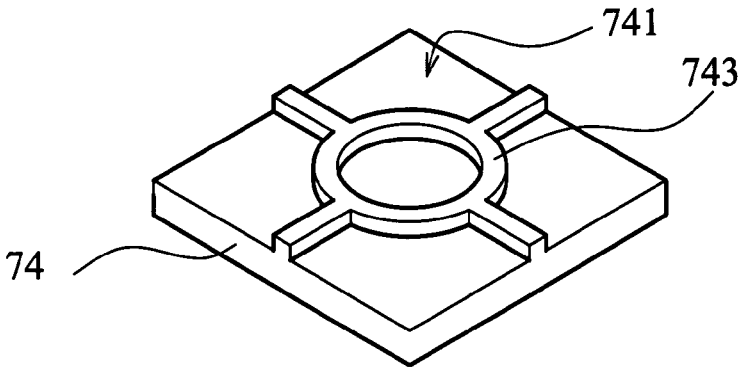

The base 24 may have a flat internal surface 241 as shown in FIG. 2, or a non-flat internal surface, as shown in FIGS. 7A to 7C. In FIG. 7A to FIG. 7C, the internal surface 741 of the base 74 faces the top portion 224 of the column body 22, and the base 24 has at least one protrusion 743 on the internal surface 741 of the base 24. The protrusion 743 is semicircular, curved, triangular, rectangular, square, trapezoid, or other shape in cross-section. It is noted that the shape and number of the protrusion 743 are not limited, and the number of the protrusion 743 can be multiple (as shown in FIG. 7B) or single (as shown in FIG. 7A and FIG. 7C). For example, when the base has a plurality of protrusions 743 on the internal surface of the base, the plurality of protrusions 743 can form a checker pattern, a determinant pattern, a symmetrical pattern, or a non-symmetrical pattern.

Referring to FIG. 2 again, the heat column 20 further includes a first wick structure 26*a*, a second wick structure 26*b*, and a working fluid W filled therein. The first wick structure 26*a* is disposed both on the inner surface of the sidewall 222 of the column body 22 and the inner surface of the top portion 224. The second wick structure 26*b* is disposed on the internal surface 241 of the base 24, and the second wick structure 26*b* is connected with the first wick structure 26*a*.

Figure 8A:
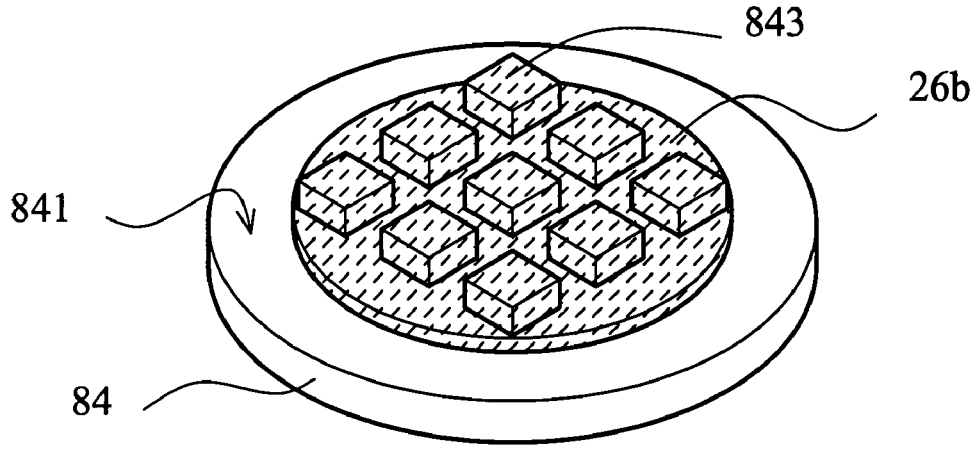
FIGS. 8A-8B are schematic views of the base and the wick structure in FIG. 2.

FIG. 8A is a schematic view of the base and the wick structure in FIG. 2. As shown, the second wick structure 26*b* is disposed along the outline of the internal surface 241 of the base 24, and the second wick structure 26*b* has uniform or non-uniform thickness. It is noted that FIG. 8A shows a plurality of protrusions 843 formed on the internal surface 841 of the base, which is different from the single protrusion 743 of the base 74 as shown in FIG. 7A.

Figure 8B:
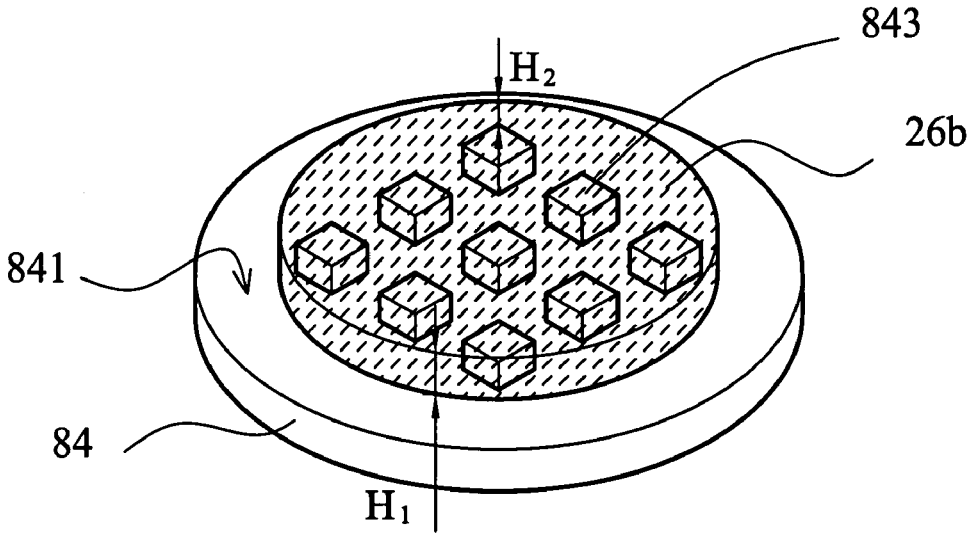

Referring to FIG. 8B, FIG. 8B is another schematic view of the base and the wick structure in FIG. 2. The second wick structure 26*b* is disposed on the internal surface 841 of the base 84 so that the second wick structure 26*b* forms a flat plane facing the top portion 224 of the column body 22. The second wick structure 26*b* includes a first depth H1 and a second depth H2, and the first depth H1 exceeds the second depth H2. The first depth H1 is the depth of the second wick structure 26*b* on the internal surface 841 without the protrusion 843. The second depth H2 is the depth of the second wick structure 26*b* on the internal surface 841 with the protrusion 843.

Referring to FIG. 2, when the heat column 20 is used, the heat source (not shown) is under the heat column 20, and the base 24 directly contacts to the heat source so as to transfer heat therefrom. Alternatively, an external base (not shown) can be disposed under the heat column 20 for contacting the heat source. When heat is applied at the base 24 (the evaporating section), the working fluid W at the end of the second wick structure 26*b* absorbs heat from the heat source and vaporizes. The resulting difference in pressure drives vaporized working fluid W to the top portion of the column body 22 (the condenser section) where the vaporized working fluid W condenses releasing the latent heat to the heat dissipation fins 62*a* or 62*b*, and enters the first wick structure 26*a*. The capillary pressure pumps the condersed working fluid W in liquid state back to the second wick structure 26*b* for re-evaporation. Circulation is repeated to achieve heat dissipation.

The column body 22 and base 24 include a high thermal conductive material, such as copper, silver, aluminum, or alloy thereof. The first wick structure 26*a* and the second wick structure 26*b* include plastic, metal, alloy, or porous non-metal material. Further, the first wick structure 26*a* and second wick structure 26*b* are disposed by sintering, gluing, stuffing, depositing, or combination thereof. The working fluid W is inorganic compound, water, alcohol, liquid metal, ketone, coolant, organic compound, or a combination thereof.

Since the column body 20 and base 24 are two independent components, the internal surface 241 of the base 24 can be manufactured as a non-flat surface so as to increase contact area between the base 24 and the wick structure 26*b* for enhancing efficiency of heat dissipation. Next, the second wick structure 26*b* of the internal surface 241 and the first wick structure 26*a* of the column 20 are independently disposed. Thus, the second wick structure 26*b* can be easily disposed on the rough base 24 with a single uniform thickness or non-uniform thickness so as to increase the surface area of the wick structure and improve evaporation efficiency of the working fluid, thereby enhancing heat dissipation efficiency of the evaporation section of the heat column 20.

The disclosed column body, with an integrally formed column body and specially designed base provides decreased waste materials and number of soldering procedures, with assembly processes simplified as are costs.

While the invention has been described by way of example and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A manufacturing method of a heat pipe, comprising the following steps:

(a) providing a body comprising a top portion and a sidewall disposed around the top portion, and the sidewall and the top portion of the body are formed as a single inseparate piece;

(b) providing a base disposed opposite to the top portion, and the base comprising a ringlike groove and an annular protrusion which is higher than the ringlike groove and close to the ringlike groove;

(c) inserting an end of the sidewall of the body into the ringlike groove to form a closed space between the ringlike groove and the sidewall of the body; and (d) pressing the annular protrusion to fill the closed space to tightly assemble the base and the body.

2. The manufacturing method as claimed in claim 1, further comprising: forming a filling tube with the top portion of the body, wherein the filling tube is outwardly protruded from the top portion, and the filling tube and the top portion are a unitary and single member.

3. The manufacturing method as claimed in claim 1, further comprising:

disposing a first wick structure on an inner surface of the sidewall and an inner surface of the top portion of the body.

4. The manufacturing method as claimed in claim 1, further comprising: disposing a second wick structure on a non-flat internal surface of the base, wherein the non-flat internal surface faces the body.

5. The manufacturing method as claimed in claim 1, further comprising:

providing at least one protrusion on an internal surface of the base, and each protrusion is semicircular, curved, triangular, rectangular, square, or trapezoid in cross-section, or providing a plurality of protrusions on an internal surface of the base, and the protrusions form a checker pattern, a determinant pattern, a symmetrical pattern, or a non-symmetrical pattern.

6. The manufacturing method as claimed in claim 1, further comprising:

disposing a second wick structure on an internal surface of the base so that the second wick structure forms a flat plane facing the top portion.

7. The manufacturing method as claimed in claim 6, further comprising: providing at least one protrusion on the internal surface of the base, wherein the second wick structure on the base comprises a first depth and a second depth, the first depth is a depth of the second wick structure on the internal surface without the protrusion, the second depth is a depth of the second wick structure of the internal surface with the protrusion, and the first depth exceeds the second depth.

8. The manufacturing method as claimed in claim 1, further comprising: disposing a second wick structure along an outline of an non-flat internal surface of the base, wherein the second wick structure has uniform or non-uniform thickness.

9. The manufacturing method as claimed in claim 1, wherein the body and the base include a high thermal conductive material, such as copper, silver, aluminum, or alloy thereof.

10. The manufacturing method as claimed in claim 1, wherein the sidewall and the top portion of the body form a hollow column shape.

11. A manufacturing method of a heat pipe, comprising the following steps:

(a) providing a body comprising a top portion and a sidewall ringed with the top portion, and the sidewall and the top portion of the body are formed as a single inseparate piece;

(b) disposing a first wick structure on an inner surface of the sidewall and an inner surface of the top portion of the body, and forming a filling tube with the top portion, wherein the filling tube is outwardly protruded from the top portion, and the filling tube and the top portion are a unitary and single member;

(c) providing a base disposed opposite to the top portion, and the base comprising a non-flat internal surface, a ringlike groove and an annular protrusion, which is higher than the ringlike groove and close to the ringlike groove, wherein the non-flat internal surface, the ringlike groove and the annular protrusion are located at the same side of the base;

(d) disposing a second wick structure on the non-flat internal surface of the base;

(e) inserting an end of the sidewall of the body into the ringlike groove to form a closed space between the ringlike groove and the sidewall of the body, wherein the non-flat internal surface faces the body; and (f) pressing the annular protrusion to fill the closed space to tightly assemble the base and the body.

12. The manufacturing method as claimed in claim 11, further comprising:

forming the first wick structure and second wick structure by sintering, gluing, stuffing, depositing, or combinations thereof, wherein the first wick structure and the second wick structure include plastic, metal, alloy, or porous non-metal material.

* * * * *